United States Patent [19]

Tanguy

[11] 4,303,994

[45] Dec. 1, 1981

[54] SYSTEM AND METHOD FOR MONITORING DRILL STRING CHARACTERISTICS DURING DRILLING

[75] Inventor: Denis R. Tanguy, Houston, Tex.

[73] Assignee: Schlumberger Technology Corporation, New York, N.Y.

[21] Appl. No.: 29,423

[22] Filed: Apr. 12, 1979

[51] Int. Cl.[3] ..... G01V 1/40; G01C 9/14

[52] U.S. Cl. ..... 367/35; 367/84; 175/45; 33/304

[58] Field of Search ..... 367/35, 84; 181/102, 181/105; 166/250, 66; 175/45; 33/304, 307, 313

[56] References Cited

U.S. PATENT DOCUMENTS

| | | | |
|---|---|---|---|
| 2,255,721 | 9/1941 | Rathingly et al. | 367/83 |
| 2,930,137 | 3/1960 | Arps | 175/45 |
| 3,587,176 | 6/1971 | Schnert | 33/313 |
| 3,622,971 | 11/1971 | Arps | 367/83 |
| 3,770,006 | 11/1973 | Sexton et al. | 367/83 |
| 3,820,063 | 6/1974 | Sexton | 367/84 |
| 3,968,473 | 7/1976 | Patton et al. | 367/83 |
| 3,983,948 | 10/1976 | Jeter | 367/83 |
| 4,021,774 | 5/1977 | Asmundsson et al. | 175/45 |
| 4,100,528 | 7/1978 | Bernard et al. | 367/83 |
| 4,103,281 | 7/1978 | Strom et al. | 367/83 |

FOREIGN PATENT DOCUMENTS

| | | | |
|---|---|---|---|
| 972556 | 8/1975 | Canada | 33/313 |
| 2049363 | 6/1969 | France | 175/45 |
| 252236 | 9/1967 | U.S.S.R. | 175/45 |

*Primary Examiner*—Nelson Moskowitz

[57] ABSTRACT

A measurement system detects a downhole drilling variable in relation to the rotational orientation of a drill string during drilling. The system includes a downhole reference signal generator and a downhole variable signal generator. The reference signal generator is coupled downhole to the drill string for generating a downhole reference (DR) signal indicative of the angular relationship between the drill string and a directional reference, such as gravity or the earth's magnetic field. The downhole variable signal generator detects downhole parameters and generates a downhole variable (DV) signal representative of a downhole parameter of interest during drilling. The DV signal and the DR signals are thereupon processed, either downhole or uphole depending in part on the telemetry system employed. The system is especially adapted for indicating the resultant lateral force applied to the drill string at the drill bit during drilling which is useful in projecting the probable drilling direction.

13 Claims, 9 Drawing Figures

FIG. 2
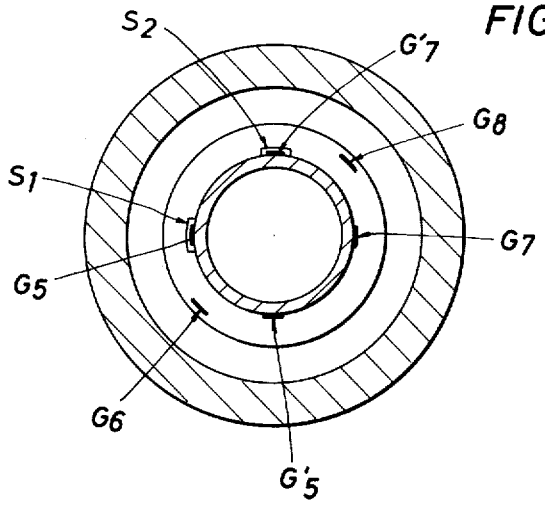
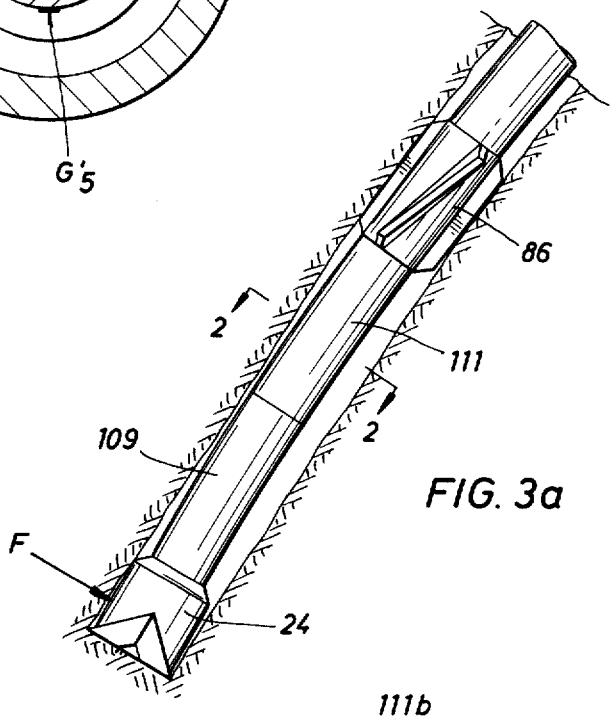
FIG. 3a
FIG. 3b
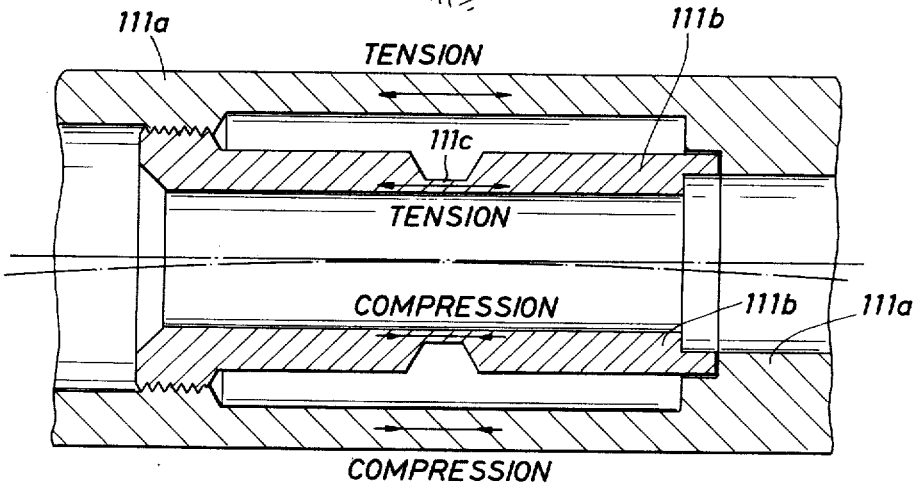

SYSTEM AND METHOD FOR MONITORING DRILL STRING CHARACTERISTICS DURING DRILLING

BACKGROUND OF THE INVENTION

The present invention relates generally to apparatus and methods for measuring downhole conditions within boreholes and more particularly relates to apparatus and methods for monitoring downhole characteristics of the drill string during drilling.

Various measuring-while-drilling techniques for telemetering data representing downhole conditions during drilling of a well have been suggested. U.S. Pat. Nos. 4,100,528 and 4,103,281 and application Ser. No. 727,685, all assigned to the assignee of the present invention and filed Sept. 29, 1976 disclose a measuring-while-drilling system utilizing a phase-shift-keyed modulation system. Logging-while-drilling systems utilizing analog motor control systems in phase-shift-keyed modulation systems are disclosed in U.S. Pat. Nos. 3,309,656; 3,789,355; and 3,820,063. The measuring-while-drilling and logging-while-drilling systems referenced therein disclose telemetry systems for monitoring downhole conditions concurrently with the drilling of the borehole.

The referenced measuring-while-drilling patents disclose various downhole conditions which may be monitored. For example, sensors may be provided for monitoring the direction of the hole, weight on bit, temperature conditions, natural gamma radiation, and formation resistivity.

There are other downhole conditions which are significant during the drilling of a borehole. Since boreholes are rarely straight, knowledge of the crookedness of the borehole is important in that excessively crooked boreholes adversely affect rotation of the drill pipe and adversely affect preproduction and production processes, such as the ease of casing placement and the wear of the sucker rods. U.S. Pat. No. 2,930,137, issued Mar. 29, 1960 to Arps suggests one attempt to solve the borehole crookedness problem using a measuring-while-drilling technique which attempts to detect the beginning of a dogleg by detecting bending moments.

The causes of borehole crookedness or deviation have been analyzed and at least in part have been attributed to the relative flexibility of the drill string and drill collars and to the forces acting on the string that cause it to bend. These forces include forces due to drill string mechanics including weight-on-bit and weight-of-the-drill collar, and forces due to interaction of the drill bit and the rock.

The significance of being able to respond to downhole conditions for controlling deviation of the borehole has been recognized. Proposals for controlling borehole deviation and direction have included control of the weight-on-bit parameter, and the control of drill string flexibility, such as control of the drill string diameter and the use and placement of stabilizers. In connection with these proposals computer analysis techniques have been developed for statically characterizing a given drill string for a given earth condition. The computer analysis provides a proposal, for example a particular placement of stabilizers and a particular weight-on-bit for a given drill string structure, which is to controllably introduce a particular bend in the drill string during drilling. The bend is attempted to be induced in the proper direction to effect the desired borehole deviation and direction.

Despite the various proposals and suggestions for controlling borehole deviation, it is believed that there have been no effective ways yet devised for predicting the future course which a drill bit will take during the drilling of a borehole. Techniques which require analysis of the previously drilled borehole are unsatisfactorily slow and burdensome and perhaps unreliable. Techniques which attempt to controllably bend the pipe during drilling are generally unreliable since there is presently no known way to monitor the nature, i.e., the direction and the degree, of the bend which has been induced. Accordingly, it would be highly desirable to provide a system which yields information on downhole drilling variables which is useful in projecting the anticipated course of the bit during continued drilling, thereby allowing corrections to be effected to the drilling operations for controlling deviations while the drill string remains in the borehole.

SUMMARY OF THE INVENTION

The present invention overcomes the above indicated shortcomings by providing a method and apparatus for monitoring the characteristics of the drill string during drilling. According to a first aspect of the invention, a downhole drilling variable is detected in relation to the rotational orientation of the drill string which in turn is coordinated with a directional coordinate reference, such as gravity or the earth's magnetic field. According to a second aspect, the method and apparatus of the invention detects the resultant lateral force applied to the drill bit during drilling, thereby providing information which is useful in projecting the future course which the drill bit will take.

According to the first aspect of the invention, the system for monitoring a downhole drilling parameter in relation to the orientation of a drill string during drilling includes a reference signal generator, a downhole variable signal generator, and a signal processor. The reference signal generator is coupled downhole to the drill string for generating a downhole reference (DR) signal indicative of the angular relationship between the drill string and a directional reference. The downhole variable signal generator is coupled downhole to the drill string for generating a downhole variable (DV) signal representing a downhole drilling variable. The signal processor is coupled to receive the DR signal and the DV signal for generating a processed signal representative of the value of the drilling variable as a function of the positional orientation of the drill string.

The signal processor may be implemented uphole, downhole, or partially uphole and partially downhole. Accordingly, the system includes a telemetry system for transferring to a location uphole the signals generated downhole. The type of signal processor, i.e., whether uphole or downhole, or partially uphole and partially downhole, depends in part upon the type of telemetry system employed. For example, the telemetry system may be a wire-line type system which can transmit data at a relatively high rate. Or, an alternative may be a measuring-while-drilling system transmitting at a relatively slower rate. When the relatively slower telemetry system is employed, it is preferred that at least some signal processing be accomplished downhole in order to utilize time which is available prior to transmitting.

According to another aspect of the invention, the downhole drilling parameter which is monitored by the aforementioned system preferably is lateral forces applied to the drill bit. For this embodiment, one or more reference signal generators are coupled to the drill string for generating a reference signal indicative of the angular relationship between the drill string and a directional reference. A strain signal generator is coupled to the drill string for generating a stain signal which is indicative of the magnitude of the resultant lateral force applied to the drill bit. Telemetering and processing circuitry is coupled to receive the strain signal and the reference signal for generating a direction signal representative of the direction of the resultant lateral force applied to the bit of the drill string. The telemetering and processing circuitry thereupon provides the direction signal to a location uphole. This system is preferably employed with the drill string of the type which is rotated during drilling of the borehole.

The reference signal generator preferably utilizes either magnetometers or accelerometers such that the directional reference is either the magnetic field of the earth or gravity, respectively. Preferably, the magnetometers or accelerometers are secured to the drill string at radii which are othogonal to one another.

According to the method of the invention, a reference signal is generated downhole to be indicative of the rotational orientation of the drill string with respect to a directional reference. A downhole variable signal is generated downhole to represent a downhole drilling variable. In response to the reference signal and to the downhole variable signal, a processed signal is generated to be representative of the value of the drilling variable as a function of the rotational orientation of the drill string.

Preferably, the step of generating the downhole variable signal comprises this step of detecting lateral forces applied to the bit of the drill string such that the downhole variable is the bending of the drill string. Preferably, the step of detecting the lateral forces comprises the step of measuring the amount of strain on the drill string at a location relatively near the drill bit.

The method of the invention also includes the step of telemetrying downhole signals to a location uphole. If the step of telemetrying includes a system which transmits at relatively slow rates, preferably the step of generating a process signal is in part performed downhole. If a telemetry system of a relatively high rate is employed, the step of generating the processed signal may be performed partially downhole or entirely uphole.

It is thus a general object of the present invention to provide a new and improved method and apparatus for monitoring downhole drilling parameters of a drill string during drilling in relation to the orientation of the drill string.

BRIEF DESCRIPTION OF THE DRAWINGS

The above noted and other features and advantages of the present invention will become more apparent in view of the following description of a preferred embodiment when read in conjunction with the drawings, wherein:

FIG. 2 is a cross sectional view taken along Section 2—2 of the drill string section in FIG. 3*a* and shows the location of various sensors utilized according to the invention;

FIGS. 3*a* and 3*b* are schematic illustrations representing a bent drill string;

DESCRIPTION OF A PREFERRED EMBODIMENT

Figures 1, 6:
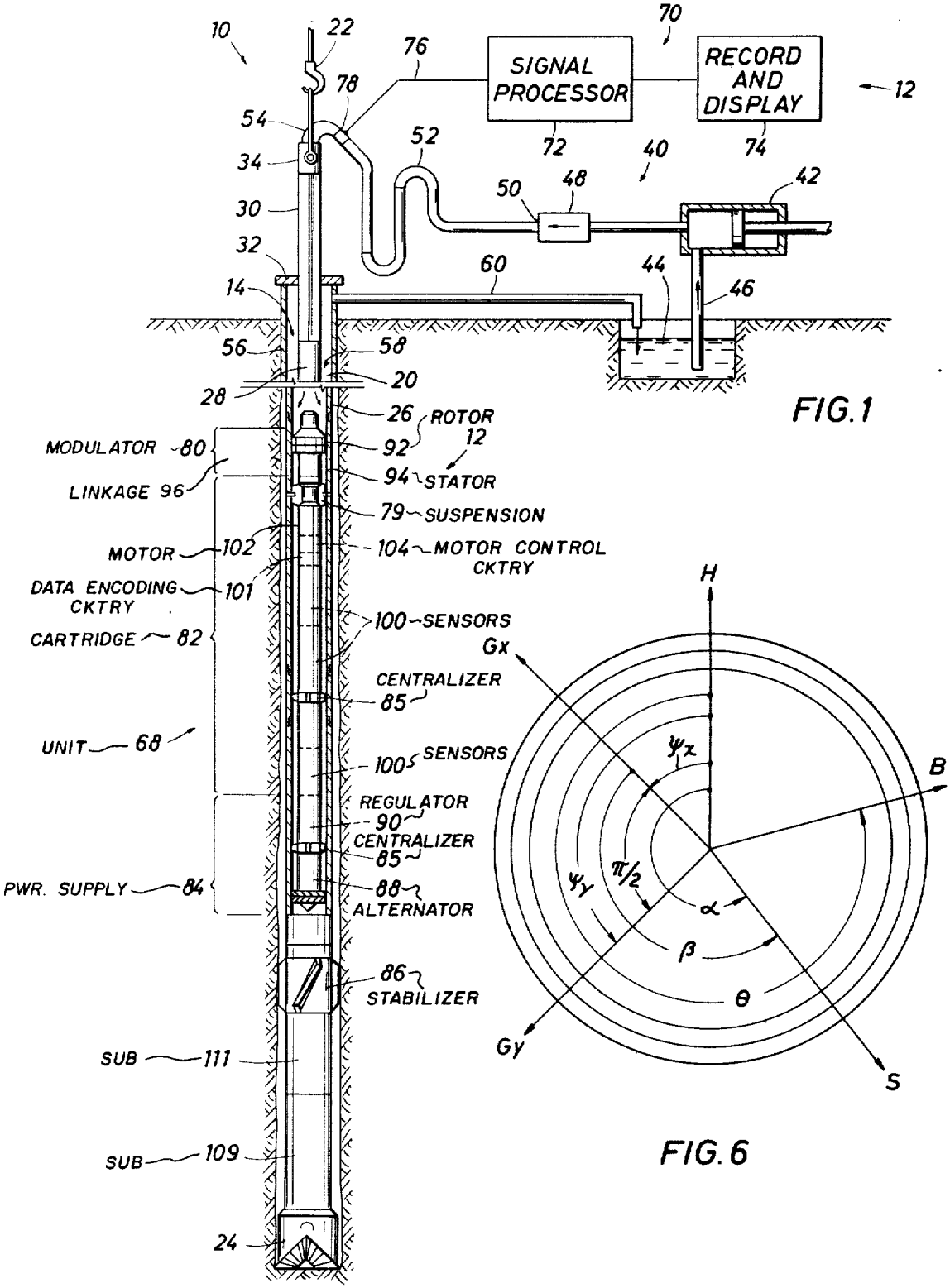
FIG. 1 is a schematic drawing showing a generalized well drilling and data measuring system according to one aspect of the invention.
FIG. 6 is a vector diagram defining various angles associated with the drill string during drilling.

Referring now to the drawings, FIG. 1 shows a well drilling system 10 in association with a measuring and telemetrying system 12 embodying the invention. For convenience, FIG. 1 depicts a land-based drilling system, but it is understood that a sea-based system is also contemplated.

The measuring and telemetrying system 12 depicted in FIG. 1 is a measuring-while-drilling system of the type described in U.S. Pat. Nos. 4,100,528 and 4,103,281. This type of measuring-while-drilling system is preferred; however, as will be apparent from the following description, other types of telemetry systems may be utilized according to the invention. For example, wireline or conductor-in-the-pipe type systems, mud pressure pulse systems, and systems which modulate signals transmitted along the pipe casing may suitably be employed.

As the drilling system 10 drills a well-defining borehole 14, the system 12 senses downhole conditions within the well and generates an acoustic signal which is modulated according to data generated to represent the downhole conditions. In the preferred and illustrated embodiment, the acoustic signal is imparted to drilling fluid, commonly referred to as drilling mud, in which the signal is communicated to the surface of the borehole 14. At or near the surface of the borehole 14 the acoustic signal is detected and processed to provide recordable data representative of the downhole conditions. This basic system is described in detail in U.S. Pat. No. 3,309,656 to Godbey which is hereby incorporated by reference.

The drilling system 10 is conventional and includes a drill string 20 and a supporting derrick (not shown) represented by a hook 22 which supports the drill string 20 within the borehole 14.

The drill string 20 includes a bit 24, one or more drill collars 26, and a length of drill pipe 28 extending into the hole. The pipe 28 is coupled to a kelly 30 which extends through a rotary drive mechanism 32. Actuation of the rotary drive mechanism 32 (by equipment not shown) rotates the kelly 30 which in turn rotates the drill pipe 28 and the bit 24. The kelly 30 is supported by the hook via a swivel 34.

Positioned near the entrance of the borehole 14 is a conventional drilling fluid circulating system 40 which circulates the mud downwardly into the borehole 14. The mud is circulated downwardly through the drill pipe 28 during drilling, exits through jets in the bit 24 into the annulus and returns uphole where it is received by the system 40. The circulating system 40 includes a mud pump 42 coupled to receive the mud from a mud tank 44 via a length of tubing 46. A desurger 48 is coupled to the exit end of the mud pump 42 for removing any surges in the flow of the mud from the pump 42, thereby supplying a substantially continuous flow of mud at its output orifice 50. A mud line 52 couples the output orifice 50 of the desurger to the kelly 30 via a gooseneck 54 coupled to the swivel 34.

Mud returning from downhole exits near the mouth of the borehole 14 from an aperture in a casing 56 which provides a flow passage 58 between the walls of the borehole 14 and the drill pipe 28. A mud return line 60 transfers the returning mud from the aperture in the casing 56 into the mud pit 44 for recirculation.

The system 12 includes a downhole acoustic signal generating unit 68 and an uphole date receiving and decoding system 70. The acoustic signal generating unit 68 senses the downhole conditions and imparts a modulated acoustic signal to the drilling fluid. The acoustic signal is transmitted by the drilling fluid to the uphole receiving and decoding system 70 for processing and display.

To this end, the receiving and decoding system 70 includes a signal processor 72 and a record and display unit 74. The processor 72 is coupled by a line 76 and one or more pressure transducers 78 to the mud lines 52. The modulated acoustic signal transmitted uphole by the drilling fluid is monitored by the transducer 78, which in turn generates electrical signals to the processor 72. These electrical signals are decoded into meaningful information representative of the downhole conditions, and the decoded information is recorded and displayed by the unit 74.

One such uphole data receiving and decoding system 70 is described in U.S. Pat. No. 3,886,495 to Sexton et al., issued May 27, 1975, entitled "Uphole Receiver For Logging-While-Drilling System," which is hereby incorporated by reference.

The downhole acoustic signal generating unit 68 is supported within one or more of the downhole drill collars 26 by a suspension mechanism 79 and generally includes a modulator 80 having at least part of the flow of the mud passing through it. The modulator 80 is controllably driven for selectively modifying the flow of the drilling fluid to thereby impart the acoustic signal to the mud. A cartridge 82 is provided for sensing various downhole conditions and for driving the modulator 80 accordingly. The generating unit 68 also includes a power supply 84 for energizing the cartridge 82. A plurality of centralizers 85 are provided to position the modulator 80, the cartridge 82, and the supply 84 centrally within the collar 26. One or more stabilizers 86 are provided for supporting and stabilizing the drill collars during drilling.

The power supply 84 may be of a design known in the art and includes a turbine positioned within the flow of the drilling fluid to drive the rotor of an alternator 88. A voltage regulator 90 regulates the output voltage of the alternator 88 to a proper valve for use by the cartridge 82.

Suitable designs for the modulator 80 are also now known in the art. It includes a movable member in the form of a rotor 92 which is rotatably mounted on a stator 94. At least part of the flow of the mud passes through apertures in the rotor 92 and in the stator 94, and rotation of the rotor selectively modifies flow of the drilling fluid when the apertures are in misalignment, thereby imparting the acoustic signal to the drilling fluid. A motor 102 is coupled to gear reduction drive linkage 96 which drives the rotor. The cartridge 82 is operably connected to the linkage 96 for rotating the rotor 92 at speeds producing an acoustic signal in the drilling fluid having (1) a substantially constant carrier frequency which defines a reference phase value, and (2) a selectively produced phase shift relative to the reference phase value at the carrier frequency. The phase shift is indicative of encoded data values representing the measured downhole conditions.

In the preferred embodiment the drive linkage 96 and the designs of the rotor 92 and stator 94 are chosen to generate five carrier cycles in the acoustic signal for each revolution of the rotor 92.

A suitable modulator 80 is shown and described in detail in U.S. Pat. No. 3,764,970 to Manning which is assigned to the assignee of this invention. Other suitable modulators 80 are described in the above-referenced Patton and Godbey patents, as well as in "Logging-While-Drilling Tool" by Patton et al., U.S. Pat No. 3,792,429, issued Feb. 12, 1974, and in "Logging-While-Drilling Tool" by Sexton et al., U.S. Pat. No. 3,770,006, issued Nov. 6, 1973, all of which are hereby incorporated by reference.

Referring now to the cartridge 82, it includes one or more sensors 100 and associated data encoding circuitry 101 for measuring the downhole conditions and generating encoded data signals representative thereof. For example, the sensors 100 may be provided for monitoring drilling parameters such as the direction of the hole (azimuth of hole deviation), weight on bit, torque, etc. The sensors 100 may be provided for monitoring safety parameters, such as used for detecting over pressure zones (resistivity measurements) and fluid entry characteristics by measuring the temperature of the drilling mud within the annulus 58. Additionally, radiation sensors may be provided, such as gamma ray sensitive sensors for discriminating between shale and sand and for depth correlation. As will be explained, the sensors 100 may also be provided for detecting lateral forces applied to the drill string during drilling.

The data encoding circuitry 101 is of the conventional type and includes a multiplex arrangement for encoding the signals from the sensors into binary and then serially transmitting them over a data line. A suitable multiplex encoder arrangement is disclosed in detail in the above referenced Sexton et al. patent, U.S. Pat. No. 3,820,063, which is hereby incorporated by reference. The cartridge 82 also includes motor control circuitry 104 for controlling the speed of the motor 102 for rotating the rotor 92 of the modulator 80 at the proper speeds to effect the desired acoustic signal generation. The motor 102 is a two or three phase AC induction motor which, in the preferred embodiment, is driven at 60 Hz by the motor control circuitry 104. Use of an induction motor for the motor 102 is not critical, as other types of motors could be adopted.

The above measuring-while-drilling system 12 is described in detail U.S. Pat. Nos. 4,100,528 and 4,103,281 and in pending patent application Ser. No. 727,685, now abandoned in favor of continuation Ser. No. 898,721, now U.S. Pat. No. 4,167,000, all filed on Sept. 29, 1976 and assigned to the assignee of the present invention. These patents and the application are expressly incorporated herein by reference for their showing of a detailed implementation of a preferred system 12.

In accordance with the invention, downhole drilling parameters are measured in relation to the rotation of the drill string. The drill string is monitored as a function of a directional reference, such as gravity or the magnetic field of the earth. The drilling parameter is thus determined as a function of the rotational orientation of the drill string. This information is either processed downhole and telemetered uphole by the system 12 or it is processed uphole after telemetry by the system 12. When the drilling parameter is the amount of lateral force on the drill bit, the invention is well-suited for providing information useful in predicting the future course which the borehole will take upon continued drilling.

In more detail, boreholes drilled deeply into the earth are rarely, if ever, straight. Therefore, the drill string 20, even though considered relatively inflexible, undergoes bending. This bending is illustrated in FIG. 3*a* which depicts a five-ten foot pony sub 109 and an approximately four foot bending sub 111 located between the drill bit 24 and the first stabilizer 86. Assuming the drill string is of the type which rotates during drilling, a given point on the section of the drill string having the bend passes through regions of compression and tension as the drill string rotates. This is illustrated in FIG. 3*b*, wherein the sub 111 is shown in partial cross section as having an outer wall 111*a* and a strain amplifier section 111*b* expandably secured to the wall 111*a*. The extent of the compression and tension is a direct function of the magnitude of the lateral force applied.

The radial force of the rock formation against the bit is illustrated in FIG. 3*a* as a resultant force F, which is inherently applied to the drill bit 24 during the drilling operation. This force results generally from axial forces on the bit, such as weight-on-bit forces, and from transverse forces on the bit due to hydraulic effects, the weight-of-the-bit which is assumed to be localized, the distributed weight of the section of the drill string 20 coupled to the drill bit, the buoyancy force.

Since the drill bit tends to follow a course tangential to the direction of the resultant force applied to the drill bit 24 during the drilling operation, measurement of the axial forces and of the transverse resultant force, with respect to magnitude and direction, can be processed to provide an indicator of the course which the drill bit 24 will take during continued drilling.

Figure 4:
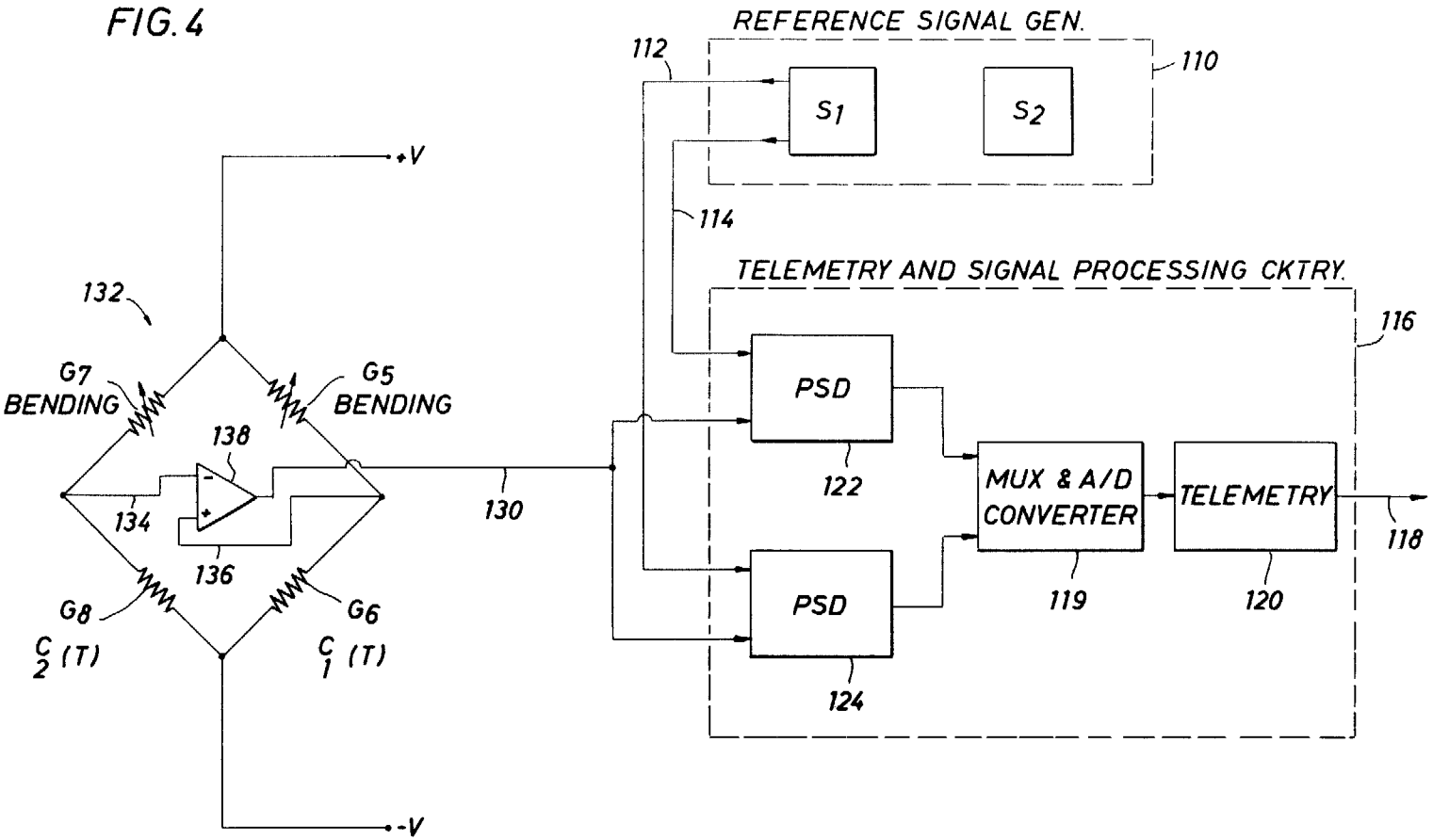
FIGS. 4 and 5*a*–5*c* are schematic diagrams of downhole electrical circuitry utilized according to the invention.

In more detail and referring additionally to FIGS. 2–4, $S_1$ and $S_2$ are provided as a reference signal generator 110. For purpose of illustration the sensors $S_1$ and $S_2$ are shown positioned at the location between the drill bit 24 and the first stabilizer 86. However, they may more conveniently be located in the cartridge 82. The sensors are secured in any suitable manner along radii of the sub 111; preferably the sensors $S_1$ and $S_2$ are located on radii orthogonal to one another in order to simplify the mathematics used for processing the signals, as will be explained.

Referring now to FIG. 4, the reference signal generator 110 generates a downhole reference signal (DR signal) which is indicative of the angular relationship between the drill string 20 and a directional reference. A directional reference, as opposed to a time reference, is used because it is unvarying. Use of time as a reference is not suitable in part because the rotational rate of the drill string is not constant, as the drill strings twists unpredictably during drilling.

In the preferred embodiment, the sensors $S_1$, $S_2$ take the form of magnetometers and the directional reference is the magnetic field of the earth. The sensors $S_1$, $S_2$ may take other forms; for example, if the well is not vertical, accelerometers may be employed, with the directional reference being the gravitational field of the earth. The DR signal takes the form of first and second reference signals respectively generated by the sensors $S_1$, $S_2$ on a pair of lines 112, 114. As is well known in the art, a magnetometer generates a signal having a value proportional to the earth's magnetic field as measured along the axis of the magnetometer. The sensors $S_1$, $S_2$ preferably are positioned on the drill string to generate the reference signals to be indicative of the strength of the magnetic field along orthogonal radii of the drill string, i.e., separated by 90 degrees of rotation.

In an alternative circuit, the reference signal generator 110 may use two axes of a commercially available tri-axial magnetometer rather than a pair of single axis magnetometers as shown in FIG. 2.

According to the preferred embodiment of the invention, the DR reference signals on the lines 112, 114 are provided as inputs to telemetry and signal processing circuitry 116. In response to the reference signals and to a downhole variable signal (DV) signal which is generated on a line 130, the telemetry and signal processing circuitry 116 generates on a line 118 a processed signal which is representative of the bending moments applied to the sub 111. The bending moments are measured using the bit 24 as a reference so that the magnitude of the lateral force F applied to the bit 24 may be represented.

In the preferred embodiment shown in FIG. 4, the circuitry 116 includes a multiplex or and analog-digital converter section 119 and a telemetry section 120. The sections 119 and 120 are implemented as part of the measuring-while-drilling system 12.

The telemetry and signal processing circuitry 116 also includes a pair of phase sensitive detectors (PSDs) 122, 124 of the conventional type. The PSDs 122, 124 generate analog signals respectively having a varying DC level of a value which represents the component of the DV signal on the line 130 which is in-phase with the DR signal on the line 114, 112. A high frequency signal may exist on the DC level such that a filter (not shown) may advantageously be employed to filter or remove the high frequency signal, leaving the analog signal to be transmitted on the line 118.

The phase sensitive detector circuits 122, 124 respectively receive as inputs the DR reference signals on the lines 112, 114 and the DV signal generated on the line 130. The DV signal is generated to be indicative of the resultant or total bending moment applied to sub 111 to thereby represent the value of the force F applied to the drill bit 24. Accordingly, the varying DC levels output from the PSDs 122, 124 represent the components of the force F in the direction of the axes of the respective magnetometers S1, S2.

A strain signal generator 132 is provided for generating the DV signal on the line 130. In the preferred and illustrated embodiment, it includes a Wheatstone bridge arrangement of strain gauges G5–G8 having output lines 134, 136 connected as inputs to a difference amplifier 138. The difference amplifier 138 may be a conventional operational amplifier and has its output connected to the line 130 for generating the DV signal.

The strain gauges G5–G8 are secured to the drill string 20, in the drill sub 111 containing the sensors $S_1$, $S_2$. The gauges are disposed at a location to allow measurement of the bending moment applied to the sub 111, as referenced from the drill bit 24. The gauges must be disposed between the bit 24 and the first stabilizer 86, and are applied to the drill string 20 in any of several ways suitable for measuring strain.

The gauges G6, G8 in the lower region legs of the Wheatstone bridge also provide temperature compensation. The gauges G5, G7 are positioned along a diameter of, and on opposite sides of, the drill string 20. In the illustrated embodiment, the gauges G5, G7 are disposed in the section 111*b* of the sub 111 which is designed to amplify stress and strain. Such amplifier designs are known in the art and can take the form of the section 111b which integrally fits inside the wall 111a as shown in FIG. 3b. The section has relatively thin regions 111c, and the strain gauges are secured within the thin regions 111c.

Alternatively, a Wheatstone bridge arrangement may be utilized having a single one of the gauges G5 or G7 disposed on the drill string 20 for measuring bending stresses at the respective point of contact.

Figure 5A:
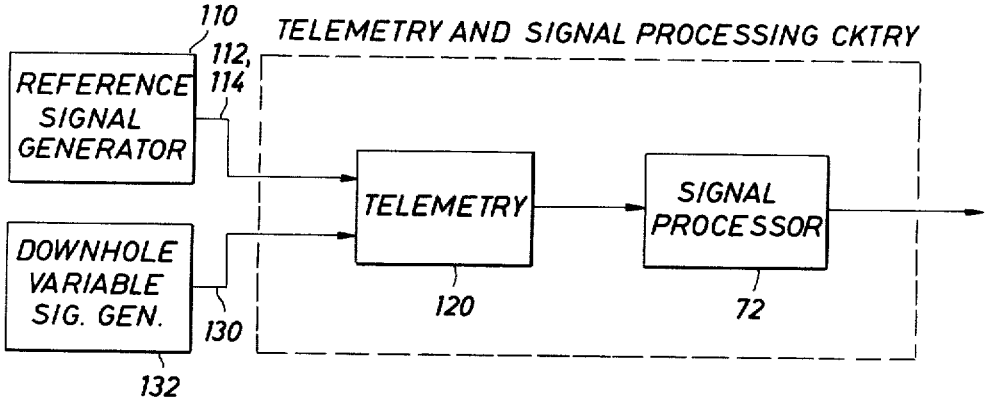
Figure 5B:
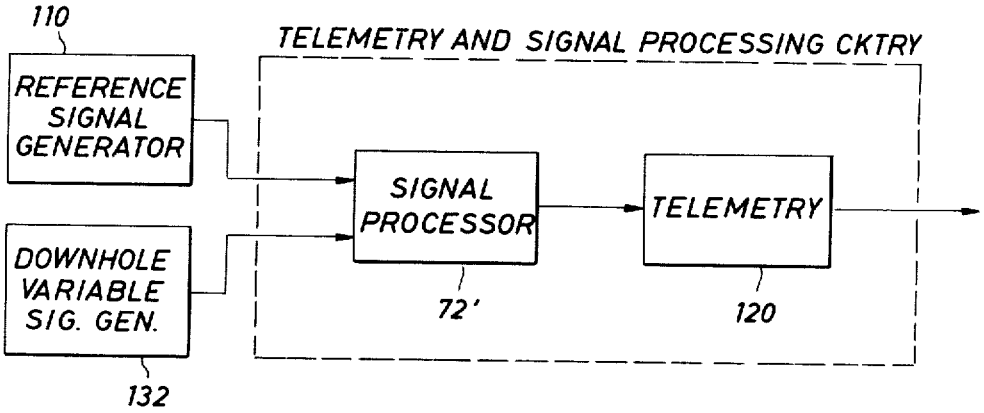
Figure 5C:
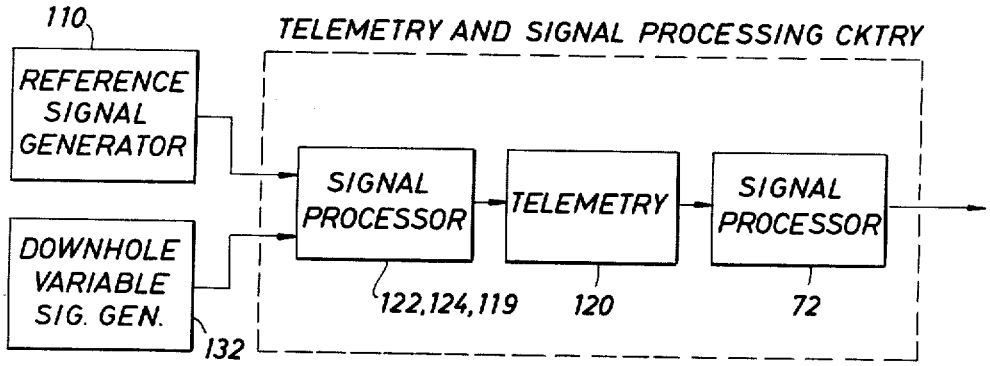

As indicated, FIG. 4 depicts a preferred embodiment utilizing a measuring-while-drilling system of the type described in FIG. 1. In this system, there is some signal processing performed downhole prior to information being telemetered uphole. Once uphole, the information is further processed by the signal processor 72 in a manner to be described subsequently. This general system, employing a rather slow telemetry system and having signal processing both uphole and downhole is shown schematically in FIG. 5c. The invention, however, is not limited to such a relatively slow telemetry system and both uphole and downwhole signal processing. FIGS. 5a and 5b depict alternative systems according to the invention. For example, in FIG. 5a the DR signal and the DV signal are directly input to the telemetry system 120 for transmission uphole. In this embodiment, essentially all signal processing is performed uphole. Preferably, the telemetry system depicted in FIG. 5a would be of the high speed type, such as in the wire line or wire-in-the-pipe type.

In the system of FIG. 5b, essentially all of the signal processing is done downhole by circuitry represented by a signal processor 72'. The signal processor 72' would have the data processing capabilities of the signal processors shown in FIG. 5c. The telemetry system 120 in FIG. 5b could be of either type, but preferably it would be of the rather slow speed type.

The above described arrangement is advantageously utilized when the drill string 20 rotates during drilling. However, the concept of the invention may be modified for use with a drilling rig which drills without rotation of the drill string 20, such as when a drill motor is utilized at the bottom of the drill string immediately adjacent to and for driving the bit 24.

THEORY OF OPERATION

For purpose of description, it will be assumed that the sensors $S_1$, $S_2$ are accelerometers, rather than magnetomers as earlier described. Referring to FIGS. 2–4, the sensors $S_1$, $S_2$ and the strain gauge assemblies G5–G7 disposed on the drill string substantially at the drill bit 24 generate the DR reference signals and the DV signals necessary for the computation of the force vector applied to the drill bit during drilling. Specifically, as the drill string rotates about a curved axis, one can define the plane tangent to the curved axis. When the diameter defined by the assemblies G5, G7 rotates to a position orthogonal to the plane, the magnitude of the measured bending stress is maximum and is defined by the strength of the measured forces of compression and tension. When the diameter defined by G5, G7 rotate to a position within the plane, there are no measured forces of compression and tension.

The detected forces of compression and tension sensed by the gauges G5, G7, according to the Wheatstone bridge arrangement shown in FIG. 4, both contribute to the difference signal applied to the amplifier 138. This signal is applied to the phase sensitive detectors 122, 124. The phase detectors 122, 124 provide an indicator of the magnitude of the resultant force in association with the DR reference signal; i.e., the component of the force F in phase with a reference coordinate such as the earth magnetic field. The outputs from the PSD's 122, 124 are transmitted for processing.

The processing which is necessary to derive the magnitude and direction of the resultant force F is apparent from the diagram of FIG. 6. FIG. 6 is a diagram relating the X-component $G_x$ and the Y-component $G_y$ of the accelerometer, the measured strain signal S, and the bending moment B to the direction H of the high side of the hole. It is to be understood that the coordinate system described in FIG. 6 is preferred; however, other coordinate systems may be selected in accordance with the invention.

The $G_x$ and $G_y$ components are the results of readings about orthogonal radii of the drill string. The angle between the high side H of the hole and the $G_x$ vector is defined as $\psi x(psi)_x$. The angle between the direction H of the high side of the hole and the $G_y$ component of the accelerometer measurement is defined as $\psi y(psi)_y$. The angle between the direction of the unknown bending moment B and the direction H of high side of the hole is defined as the angle $\theta$(theta). The angle defined between the $G_x$ component and the direction of the force signal S is defined as the angle $\beta$(beta). The angle defined between the direction H of the high side of the hole and the direction of the force signal S is defined as the angle $\alpha$(alpha). As already indicated, the $G_x$ and $G_y$ components of the direction signal are at 90°.

For a rotating drill string, wherein the force signal produces a vector S which varies with time, and wherein the direction signals from the accelerometer produce $G_x$ and $G_y$ vectors which vary with time, the angles $\psi_x$ and $\psi_y$ and $\alpha$ are functions of time. Due to drilling characteristics, the direction of the bending moment B may be considered to change only slowly with respect to time. Thus, the angle $\theta$ may be considered constant for a given set of measurements.

Assuming that the angle between the normal to the plane defined by the $G_x$ and $G_y$ vectors and vertical is the angle $\phi$(phi), it may be shown that the following relationships obtain:

$$G_x = G \sin \phi \cos \psi x \qquad \text{EQN. 1}$$

$$G_y = G \sin \phi \cos \psi y \qquad \text{EQN. 2}$$

$$S = B \cos (\theta - \alpha) \qquad \text{EQN. 3}$$

$$\psi x = \psi xo + \omega t \qquad \text{EQN. 4}$$

$$\psi y = \psi yo + \omega t \qquad \text{EQN. 5}$$

$$\alpha = \alpha o + \omega t \qquad \text{EQN. 6}$$

where G is the magnitude of the gravitational force of the earth and the zero-subscripted terms are values at an arbitrary initial time reference.

Operation of the pair of phase sensitive detectors 122, 124 produces the direction signals, which are defined here as $S.G_x$, $S.G_y$ to indicate the operation of the respective PSD. By recognizing that $\alpha - \psi x = \beta$ which is a fixed angle known by measurement prior to putting the system into the borehole, and by applying conventional mathematical relationships, it can be shown that $$\tan^{-1}\frac{S \cdot Gy}{S \cdot Gx} = \beta + \theta \qquad \text{EQN. 7}$$

Since $\beta$ is known, then the sought-after value of the angle $\theta$ is immediately obtained; i.e., the direction of the bending moment referenced to the drill bit 24 is obtained.

It can also be shown that the magnitude of the bending moment B is defined by the equation $$B=[(S.G_x)^2+S.G_y)^2]^{1/2} \qquad \text{EQN. 8}$$

It will be appreciated that, since there is no direct way to measure an angle of rotation of the drill string 20 without an inertial device, the direction of the bending moment B is obtained in the preferred embodiment by comparing the time elapsed between the observation of magnetic north and the observation of the maximum value of the force signal to the total time between two successive observations of magnetic north. Because the rotation of the drilling string does not necessarily proceed at a perfectly constant rate, a time averaging of the measurements may be required.

Thus, if the location of the drill bit is known from other measurements, such as measurements taken using measuring-while-drilling techniques, the anticipated drilling direction vis-a-vis the already drilled borehole may be obtained by utilizing the above determined values.

Although the invention has been described in its preferred form with a certain degree of particularity, it is understood that the present disclosure has been made by way of example only. Numerous changes in the details and construction of the combination and arrangement of components will be apparent without departing from the spirit and the scope of the invention.

I claim:

1. A system operable during the drilling of a borehole for generating a direction signal representative of the direction which the drill bit of a drill string will take during continued drilling, the drill string being of the type which is rotated during drilling of the borehole, comprising:

a. a reference signal generator coupled to the drill string for generating during drilling a reference signal indicative of the rotational orientation of the drill string about its axis with respect to a directional reference;

b. a strain signal generator coupled to said drill string for generating during drilling a strain signal indicative of the lateral forces applied to said drill bit as a function of the rotational orientation of the drill string; and c. telemetering and processing circuitry coupled to receive said strain signal and said reference signal for generating said direction signal to represent the phase between said strain and reference signals, thereby to represent the direction of the resultant of said lateral forces as a function of said directional reference.

2. The system according to claim 1 wherein said reference signal generator includes first and second magnetometers, said directional reference being the magnetic field of the earth.

3. The system according to claim 2 wherein said magnetometers are secured to the drill string at radii which are orthogonal to one another.

4. The system according to claim 1 wherein said reference signal generator includes a pair of accelerometers, said directional reference being the direction of gravity.

5. The downhole assembly according to claim 4 wherein said accelerometers are secured to the drill string at radii which are orthogonal to one another.

6. The downhole generator according to claim 1 wherein said signal processor includes first and second phase-sensitive detectors coupled to receive said strain signal and to receive said reference signal for generating a processed signal indicative of the value of said lateral forces as a function of the angular relationship between the drill string and said directional reference.

7. A method for monitoring the operational characteristics of a drill string during drilling for determining the future course which the drill bit will take, comprising the steps of:

a. generating downhole during drilling a reference signal indicative of the varying rotational orientation of the drill string about its axis with respect to a directional reference;

b. generating downhole during drilling a downhole variable signal representing lateral forces applied to the bit of the drill string as a function of the varying rotational orientation of the drill string; and c. in response to said reference signal and to said downhole variable signal, generating a processed signal representative of the phase between said reference signal and said downhole variable signal, thereby representing the direction of the resultant of said lateral forces with respect to the directional reference, thereby indicating the future direction which the bit will take.

8. The method according to claim 7 and including the step of telemetrying the processed signal to an uphole location for display.

9. The method according to claim 7 wherein said step of detecting the lateral forces includes the step of measuring the amount of strain on said drill string at a location relatively near said drill bit.

10. During the drilling of a borehole using a rotating drill string and drill bit, a method for predicting the direction which the borehole will take during continued drilling, comprising the steps of:

a. during rotation of the drill bit, generating downhole a reference signal having values indicative of the rotational orientation of the drill string about its axis with respect to a directional reference;

b. during rotation of the drill bit, generating downhole a strain signal indicative of the lateral forces applied to the drill bit as a function of the rotational orientation of the drill string;

c. in response to said reference signal and to said strain signal, generating a first processed signal representing the phase between said reference signal and said strain signal thereby to represent the lateral forces applied to the drill bit with respect to said directional reference;

d. generating a position signal having a value representative of the positional orientation of the drill bit; and e. in response to said first processed signal and to said position signal, generating a direction signal having a value representative of the direction of the resultant of said lateral forces applied to said drill bit as a function of the positional orientation of the drill bit, thereby being indicative of the future direction which the bit will take during continued drilling.

11. The method according to claim 10 wherein one or more of said steps (c-e) are performed downhole, and the method further includes the step of telemetrying uphole one or more of said processed signals.

12. The method according to claim 10 wherein the step of generating the strain signal includes the step of measuring the amount of strain imposed upon the drill string at a location relatively near the bit, thereby measuring a bending moment applied to the drill string.

13. The method according to claim 12 wherein said step of measuring comprises the step of measuring the strain at first and second points at the ends of a diameter of the drill string.

* * * * *